US007146693B2

(12) United States Patent
Weiner

(10) Patent No.: US 7,146,693 B2
(45) Date of Patent: Dec. 12, 2006

(54) TIP SHEARING PATTERN IN CARPET

(76) Inventor: Robert S. Weiner, P. O. Box 2399, Dalton, GA (US) 30722-2399

( * ) Notice: Subject to any disclaimer, the term of this patent is extended or adjusted under 35 U.S.C. 154(b) by 0 days.

(21) Appl. No.: 10/962,834

(22) Filed: Oct. 12, 2004

(65) Prior Publication Data

US 2005/0045082 A1 Mar. 3, 2005

Related U.S. Application Data

(63) Continuation of application No. 10/349,991, filed on Jan. 23, 2003, now abandoned.

(51) Int. Cl.
*D06C 23/02* (2006.01)
*D06C 13/08* (2006.01)

(52) U.S. Cl. ..... 26/16; 26/9; 26/8 C

(58) Field of Classification Search ..... 26/8 R, 26/9, 10 C, 8 C, 16, 15 R, 10 R, 15 FB, 26/2 R, 69 R, 69 C; 28/159, 160, 163, 170; 83/562, 686, 928, 561, 37, 839–843; 428/89, 428/92–95, 97; 69/23, 25, 27, 41, 42
See application file for complete search history.

(56) References Cited

U.S. PATENT DOCUMENTS

| | | | | | |
|---|---|---|---|---|---|
| 2,822 | A | * | 10/1842 | Pitts | 26/16 |
| 249,859 | A | * | 11/1881 | Smith | 26/16 |
| 590,457 | A | * | 9/1897 | Lancaster et al. | 26/69 C |
| 605,710 | A | * | 6/1898 | Goodall | 26/16 |
| 1,553,830 | A | * | 9/1925 | Marble | 26/16 |
| 1,708,763 | A | * | 4/1929 | Huss et al. | 26/16 |
| 2,758,355 | A | * | 8/1956 | Kradoska | 26/16 |
| 2,876,525 | A | * | 3/1959 | Janney et al. | 428/88 |
| 2,977,660 | A | * | 4/1961 | Gebert et al. | 26/16 |
| 3,357,075 | A | * | 12/1967 | Law | 28/160 |
| 3,422,512 | A | * | 1/1969 | Law | 26/16 |
| 3,566,492 | A | * | 3/1971 | Handley et al. | 26/16 |
| 3,758,924 | A | * | 9/1973 | Holm | 26/16 |
| 3,818,554 | A | * | 6/1974 | Davidson | 26/16 |
| 4,112,560 | A | * | 9/1978 | Willbanks | 28/160 |
| 4,391,866 | A | * | 7/1983 | Pickens et al. | 428/92 |
| 4,576,848 | A | * | 3/1986 | Dillon et al. | 428/89 |

* cited by examiner

*Primary Examiner*—Amy B. Vanatta
(74) *Attorney, Agent, or Firm*—Stephen J. Stark; Miller & Martin PLLC

(57) ABSTRACT

An embossed surface is positioned opposite a pile fabric from a tip shearing apparatus. As the blades of the tip shearing apparatus contact the carpet, the embossed surface selectively elevates selected portions of carpet relative to unselected portions so that a design corresponding to the design of the embossed surface is inversely cut into the carpet.

7 Claims, 2 Drawing Sheets

TIP SHEARING PATTERN IN CARPET

CLAIM OF PRIORITY

This application is a continuation of U.S. patent application Ser. No. 10/349,991 filed Jan. 23, 2003, now abandoned.

BACKGROUND OF THE INVENTION

1. Field of the Invention

The present invention relates to a method and apparatus for finishing textile products, and more particularly, to a method and apparatus for tip shearing tufted carpet utilizing an embossed surface below the backing which extends portions of the carpet closer to the cutting heads thereby cutting a pattern into the carpet which inversely corresponds with the extended portions of the embossed surface.

2. Brief Description of Related Art

One method of finishing tufted carpet is to tip shear the loop ends to a uniform height. U.S. Pat. No. 4,323,612, which issued in 1982, discusses carpets finished in this manner.

The traditional method of tip shearing carpets involves running tufted carpet over a smooth roller where the roller contacts the polypropylene backing on the bottom of the carpet. The tufted loops are then cut to a uniform height utilizing a cutter having one or more blades which cuts the tufted loops to a uniform height relative to the back of the polypropylene layer on the back of a carpet since the blades of the cutter are a fixed distance from the roller. The greater a distance the tips of the pile extend from the backing, the greater amount is sheared.

The tip-shearing of carpet is utilized to provide a visual effect since the sheared ends provide a different visual effect than non-sheared ends. It has been discovered that the more material which is sheared away (i.e., the shorter lengths the carpet tufts are cut to extend from the backing), the darker most carpets become. It has also been discovered that loops are more durable and take wear better than sheared loops.

In some applications, it has been found that carpet may be tufted to high and low loops with the high loops resembling a design. The high loops may then be tip sheared to create a different effect than if they were allowed to remain as loops with the low loops not being cut in this process. While this technique produces an attractive carpet design, the sheared high loops extend a distance above the non-sheared low loops. Accordingly the sheared high loops take the brunt of the wear. Accordingly a need exists for a pattern to be cut into a carpet where the cut pattern extends a distance below the remaining loops.

U.S. Pat. No. 6,035,749 discloses a method of patterned shearing of pile fabrics which effectively utilizes compressed air to provide a particular pattern when utilized in conjunction with an otherwise uniform cutting and severing apparatus. While this reference teaches an excellent way of producing patterns in pile fabrics, it requires the addition of compressed air and jets to be placed proximate to the cutter assembly. This would require retrofitting existing tip shearing cutters with compressed air capability, jets and a controller for the jets.

Accordingly, a need exists to produce a design in carpets without necessarily requiring retrofilling and/or providing compressed air capability.

SUMMARY OF THE INVENTION

A need exists to be able to utilize existing tip shearing cutter equipment with a simple modification and/or addition to provide a patterned visual effect in the top surface of a pile fabric so that the finish fabric has a plurality of heights as measured from the back of the polypropylene backing.

Another need exists for tip-shearing carpet to provide a visual effect which is recessed relative to surrounding carpet portions.

Another need exists for selectively tip shearing carpet to at least two depths utilizing an otherwise uniform cutting shearing apparatus.

Another need exists to selectively elevate portions of pile fabric relative of non-selected portions to assist in providing a desired multi-height pattern when the elevated carpet portions contact the cutting blade or blades.

Accordingly, an embossed surface is positioned below the backing of the carpet during the shearing process. The embossed surface has raised portions which elevate portions of the carpet closer to the cutter of the tip shearing machine. These elevated portions are cut to a deeper depth than surrounding carpet portions. Accordingly, the cut pattern is inversely cut in the pile fabric relative to the embossed surface. This technique and apparatus is believed to result in a longer wearing carpet product.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
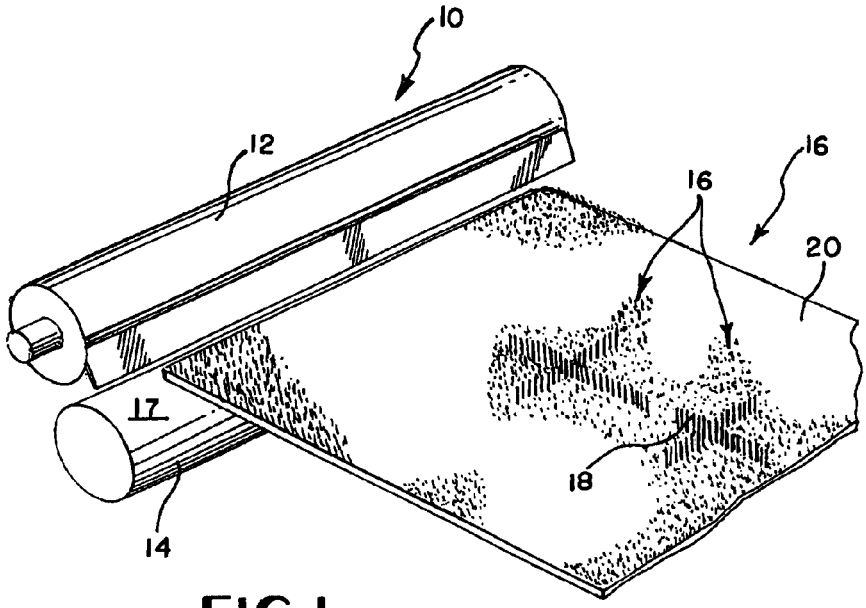
FIG. 1 PRIOR ART
FIG. 1 shows a prior art tip shearing apparatus.

Accordingly, FIG. 1 shows a portion of a prior art tip shearing mill 10 having a cutter 12 and a smooth roller 14. As carpet 16 is passed intermediate the cutter 12 and the roller 14, the tips 16, or ends, are sheared to a uniform height as measured from the smooth cylindrical exterior surface 17 of the roller 14. As shown in FIG. 1, a high pile 18 height has been tufted to create a cross pattern which extends a distance above the lower pile 20. After shearing, the high pile loops will be cut, but preferably not down as far as the top of the low pile 20. This is known in the art to create a pattern. However, a disadvantage of this process is that the sheared or cut pile design (formerly high pile 20) is not as durable as the lower loops. Thus some designs have been found to wear disproportionately faster than the rest of the carpet since they bear the traffic as they extend a distance above the lower pile height.

Figure 2:
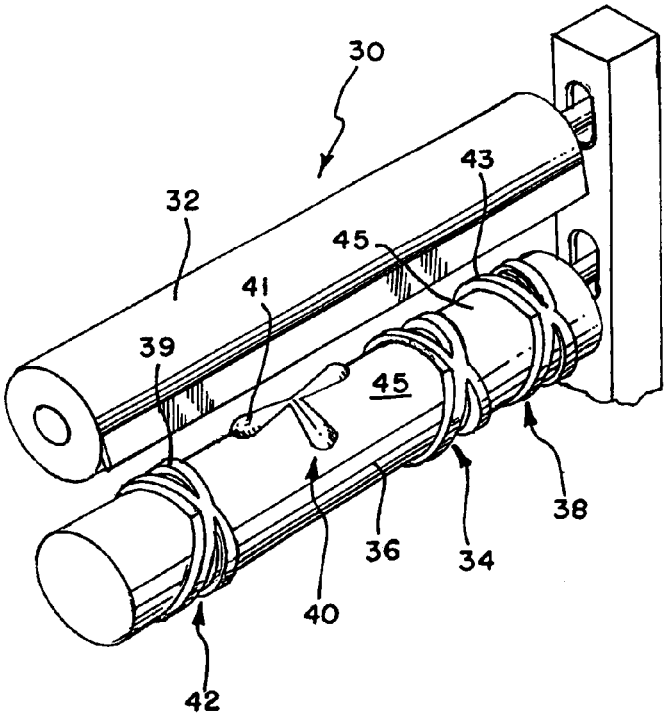
FIG. 2 shows a first embodiment of a tip shearing apparatus of the present invention.

FIG. 2 shows a tip shearing mill 30 of the preferred embodiment. The mill includes a shearing apparatus, such as a cutter 32, and an embossed surface 34 on a roller 36. The embossed surface 34 is shown attached to the roller 36 and having three distinct designs 38,40,42, but as shown in and described relative to FIG. 5, other embossed surfaces may be utilized with or without a roller 36. Furthermore, the one or more designs 38,40,42 are illustrative in nature and could have any particular shape desired utilized using the technology described herein. As shown in FIG. 2, the designs 38,40,42 have elevated surfaces 39,41,43 spaced a distance above unelevated roller surface 45.

Figure 3:
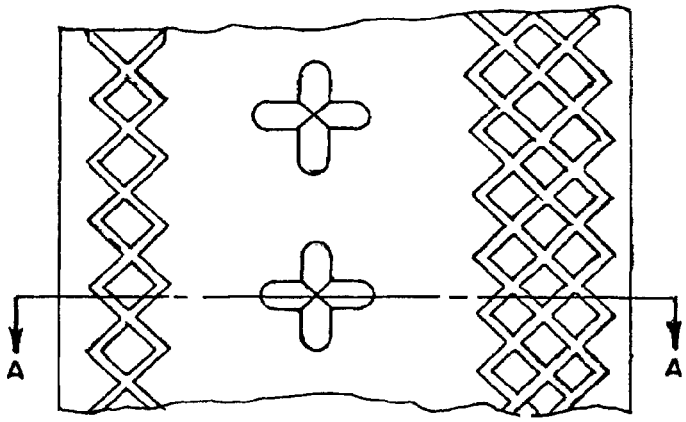
FIG. 3 shows a carpet section produced using the tip shearing apparatus of FIG. 2.
Figure 4:
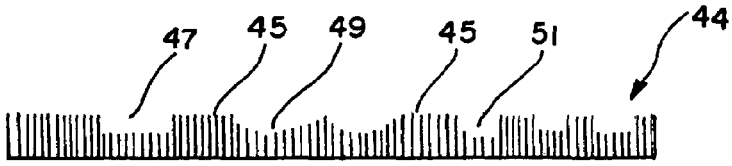
FIG. 4 shows a cross section of carpet taken along the line A-A of FIG. 3.

FIG. 3 shows a carpet section 44 which has been run through the mill 30. Notice that the design of the embossed surface 34 is now apparent on the carpet 44. However, as shown in FIG. 4, the designs 38,40,42 have been cut into the carpet 44. For instance, suppose that the carpet 44 is formed of a uniform pile height. As reflected by FIG. 4, as the carpet 44 passes over the embossed surface 34, the portions which now have the design are elevated a greater distance, i.e., moved closer to the cutter 32, so that the blade, or blades, of the cutter 32 cut more material from the carpet where the embossed surface 34 pushes the carpet closer to the cutter 32, even though the cutter 32 is cutting at a uniform height relative to the roller 36. This results in the embossed surface 34 effectively being cut into the carpet 44 as shown in FIG. 4. In fact, the depth of recessions 47,48,49 approximately corresponds with the height of the elevated surfaces 39,41, 43 relative to the unelevated surface 45.

Embossed surfaces 34 for may take a variety of forms. As shown in FIG. 2, a roller 36 may be machined or otherwise constructed so that designs 38,40,42, or other ornamentation extend a distance above an adjacent exterior and otherwise smooth cylindrical portion of the roller such as unelevated roller surface 45. The designs 38,42 may perpendicularly extend a predetermined distance from the unelevated surface 45 and/or extend a variety of distances gradually as shown by design 40.

Figure 5:
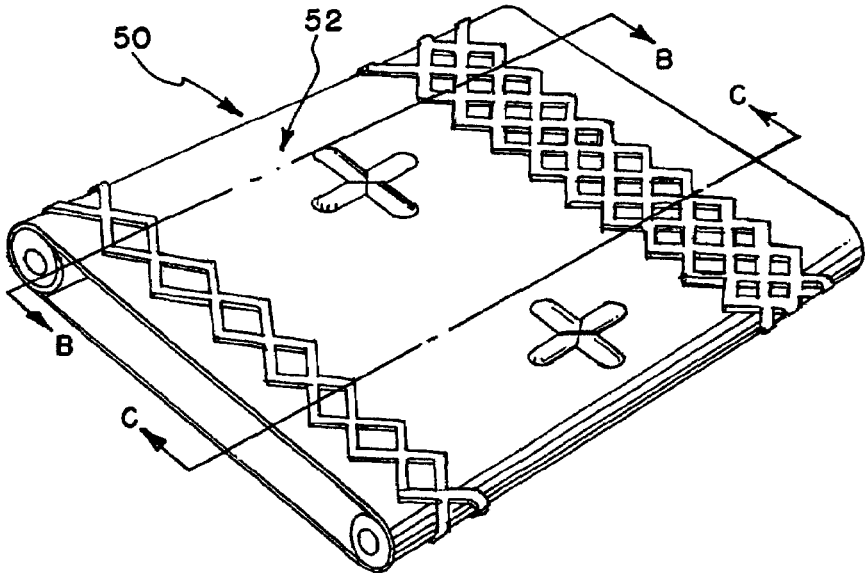
FIG. 5 shows a side elevational view of an alternatively preferred embodiment for an embossed surface for use with the cutter of FIG. 2.

Embossed surfaces 34 may be created on a roller 36 as illustrated in FIG. 2 or may be created in sheet form as shown in FIG. 5. FIG. 5 shows a continuous loop 50 having an embossed surface 34 thereon which could be utilized with the cutter 32 of FIG. 2. Alternatively a sheet segment 52 such as shown intermediate B—B and C—C in FIG. 5 may be fed along with carpet across the smooth roller 14 shown in FIG. 1 or other structure to achieve the desired pattern. The sheet 50 need not be continuous as illustrated, but the continuous sheet 50 is believed to be a convenient structure to utilize, especially for a repeating pattern.

A method of utilizing the apparatus, or mill 30, involves directing carpet 44 intermediate the embossed surface 34 and the cutter 32, having the cutter cut at a uniform height and thereby produce a design in the carpet 44, or other pile fabric, inversely corresponding to the design of the embossed surface.

As shown in FIG. 2, at least one of the embossed surface 34 and or cutter 32 is moveable relative to the other so that the desired amount of cutting may take place. Some carpets may have longer pile height than others, some may have thicker backing, and the ability to adjust the predetermined distance from the cutter to the embossed surface and/or roller, if utilized, is believed to be advantageous.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set fourth the nature of the invention, what is claimed is:

1. A method of shearing selected portions of carpet pile extending from backing of pile fabric to cut at least one levels of pile height relative to uncut pile, comprising the steps of:

a. providing a shearing apparatus positioned for shearing tips of carpet pile extending from a pile fabric tufted through a backing with at least one blade, the greater a distance that said tips extend from said backing, the greater an amount is sheared;

b. feeding said pile fabric to said shearing apparatus;

c. while shearing said pile fabric, selectively elevating portions of the pile fabric with an embossed surface positioned opposite the pile fabric from the shearing apparatus; and d. shearing said elevated pile portions with said shearing apparatus, such that elevated pile is cut to at least one different height shorter than unelevated pile, said unelevated pile containing loops which remain uncut and extend an elevation above the cut pile.

2. The method of claim 1 wherein the step of shearing provides a design in the pile fabric substantially inverse to a design of the embossed surface.

3. The method of claim 1 wherein the embossed surface is located on a roller, and the roller rotates as the pile fabric is fed across the roller spaced apart from the shearing apparatus.

4. The method of claim 3 wherein the pile fabric is continuously fed intermediate the embossed surface and the roller.

5. The method of claim 1 wherein the step of elevating selected pile portions comprises elevating said selected pile portions to a predetermined elevation.

6. The method of claim 1 wherein the embossed surface is driven by a roller with said embossed surface disposed intermediate the roller and the shearing apparatus.

7. The method of claim 1 wherein the selectively elevated portions of the embossed surface are positioned relative to selected portions of a first elevation of at least two elevations of pile fabric opposite of the shearing apparatus.

* * * * *